US009295873B1

(12) United States Patent
LaCaze

(10) Patent No.: US 9,295,873 B1
(45) Date of Patent: Mar. 29, 2016

(54) ROTATIONAL RESISTANCE DEVICE

(71) Applicant: John Joseph LaCaze, Opelousas, LA (US)

(72) Inventor: John Joseph LaCaze, Opelousas, LA (US)

(73) Assignee: Blu Sky Solutions, LLC, Opelousas, LA (US)

( * ) Notice: Subject to any disclaimer, the term of this patent is extended or adjusted under 35 U.S.C. 154(b) by 0 days.

(21) Appl. No.: 14/711,539

(22) Filed: May 13, 2015

Related U.S. Application Data

(60) Provisional application No. 62/126,461, filed on Feb. 28, 2015.

(51) Int. Cl.

| | |
|---|---|
| ***A63B 23/08*** | (2006.01) |
| ***A63B 23/10*** | (2006.01) |
| ***A63B 21/045*** | (2006.01) |
| ***A63B 21/04*** | (2006.01) |
| ***A63B 22/14*** | (2006.01) |
| ***A63B 21/22*** | (2006.01) |
| ***A63B 21/00*** | (2006.01) |
| ***A63B 21/02*** | (2006.01) |

(52) U.S. Cl.
CPC ..... *A63B 21/22* (2013.01); *A63B 21/00069* (2013.01); *A63B 21/023* (2013.01); *A63B 21/0435* (2013.01); *A63B 21/1496* (2013.01); *A63B 22/14* (2013.01)

(58) Field of Classification Search
CPC ..... A63B 21/00069; A63B 21/00072; A63B 21/00076; A63B 21/023; A63B 21/025; A63B 21/04; A63B 21/0407; A63B 21/0435; A63B 21/045; A63B 21/0455; A63B 21/1465; A63B 21/1496; A63B 21/22; A63B 22/14; A63B 22/18; A63B 22/185; A63B 23/02; A63B 23/0205; A63B 23/0216; A63B 23/0482; A63B 2023/003; A63B 26/003
USPC ..... 482/147
See application file for complete search history.

(56) References Cited

U.S. PATENT DOCUMENTS

| | | | | |
|---|---|---|---|---|
| 4,200,282 | A * | 4/1980 | Agyagos | 482/147 |
| 4,319,749 | A * | 3/1982 | Agyagos | 482/147 |
| 4,679,550 | A * | 7/1987 | Quam et al. | 601/128 |
| 4,953,858 | A * | 9/1990 | Zelli | 482/147 |
| 5,518,476 | A | 5/1996 | McLeon | |
| 6,176,817 | B1 | 1/2001 | Carey et al. | |
| 7,621,861 | B1 | 11/2009 | Kalember et al. | |
| 7,909,747 | B1 | 3/2011 | LaCaze | |
| 2007/0027009 | A1 | 2/2007 | Arnold | |
| 2011/0287914 | A1* | 11/2011 | Morris | 482/147 |
| 2011/0312479 | A1* | 12/2011 | Caponigro | 482/147 |
| 2012/0225741 | A1* | 9/2012 | Antolick | 473/452 |

* cited by examiner

*Primary Examiner* — Oren Ginsberg
(74) *Attorney, Agent, or Firm* — Matthew J. Lattig; Charter IP, LLC

(57) ABSTRACT

A rotational resistance system is described herein, the system being adapted for a user so as to facilitate exercise of muscles throughout upper and lower extremities of the user's body. The system may include a pair of separate rotational resistance devices in side-by-side relation for placement of a corresponding hand or foot of a user thereon. Each device may further include a base adapted for placement on a floor or planar surface, a hollow foot support structure on the base, a top surface of which is inclined at an upward angle relative to horizontal as taken from the rear of the foot support structure to the front of the foot support structure, and a rotatable foot plate contained in and serving as part of the top surface of the foot support structure, the foot plate connected to a means for providing resistance and release of resistance.

18 Claims, 6 Drawing Sheets

ROTATIONAL RESISTANCE DEVICE

CROSS-REFERENCE TO RELATED APPLICATIONS

The present application claims the benefit under 35 U.S.C. §119(e) of U.S. Provisional Patent Application No. 62/126,461 to the inventor, filed Feb. 28, 2015, the entire contents of which is hereby incorporated by reference herein.

BACKGROUND

1. Field

The example embodiment in general is directed to a rotational resistance device adapted for warm-up/activation before and recovery after exercise, rehabilitation from injury, functional training, and performance.

2. Related Art

Various types of conventional exercise and/or therapy devices have been developed to provide an effective means for supplying resistance and movement to a person's body for keeping fit by working out against a given resistance, either self-imposed, with an external force, or via rotation. Typically, these conventional exercise devices are configured so as to exercise or rehabilitate different parts of the human body using some type of force, sometimes in the form of weights and/or energy creating resistance. Movable belt devices also create a stationary running platform.

FIG. 1 is a perspective view of a conventional exercise and therapy device. Referring to FIG. 1, the device 10 includes a base 12 (i.e., a dish exercise and therapy platform) having an upper flat surface 14, and a plurality of ball bearings 22 movably held within respective bearing housings 32. The device 10 also includes a bearing support base 52 having a plurality of support blocks 42, 44. The blocks 42, 44 are fixedly attached thereto and to the ball bearing housings 32 so as to be held in place above the flat surface 14 of the base 12. The device 10 has a circular dish-shaped platform means with its curved lower surface 16 in contact with the ball bearings 22. The circular platform means is rotatably placed upon the ball bearings 22 and readily moved in the horizontal and vertical directions when any force is exerted upon its flat upper surface 14.

Device 10 further includes a tensioning mechanism 50 consisting of an upper coated tensioning cable 62, held close to a hand rail 76 by one or more cable retaining straps 66, an upper tensioning cable retaining bracket 68, notched tensioning adjustment mechanism 72, and tensioning adjustment mechanism handle 74. A safety feature for device 10 is served by the hand rail 76 and the removable stationary step platform 82.

When the tensioning adjustment mechanism handle 74 is placed in the notch at a position furthest away from the upper tensioning cable retaining bracket 68, the greatest amount of tension is placed upon base 12 at the distal end of the tensioning mechanism 50. Accordingly, base 12 is essentially set motionless at this setting, allowing the user to safely move onto and off the removable stationary step platform 82, as well as onto and off, the rotatable exercise and therapy platform (base 12).

FIG. 2 is a partial isometric view of another conventional rotational exercise apparatus. The exercise apparatus 110 is designed to strengthen and tone the human body and includes a collapsible stationary support frame 120 with horizontal gripping arms 122, and a base plate 152 attached in a horizontal position to the frame 120. A rotatable platform 154 is positioned atop base plate 152 and freely rotates with a pair of swiveling foot plates 156 mounted on the platform upper surface. During use, a person places their foot on each foot plate 156 and exercises by rotating and counter rotating both the platform 154 and the foot plates 156 simultaneously, while maintaining balance by holding onto the gripping arms 122.

The inventor's own patent (U.S. Pat. No. 7,909,747, issued Mar. 22, 2011 and entitled "Exercise Device and Method", hereafter the "'747 patent") in general is directed to a method and device for exercise of the gluteus medius and gluteus minimus muscle complex against resistance in internal rotation, the tibialis posterior in internal rotation and inversion, the piriformis muscle and its synergists in external rotation, and the peroneal muscles in external rotation and eversion.

FIG. 3 is a front perspective exploded view of another conventional exercise device (as shown and described in the inventor's '747 patent) which imparts resistance to rotational movement. Referring to FIG. 3, the device 200 includes a base 212, a rotatable foot support plate 216 mounted on the base 212 at an angle (see tilted top 214) and having a resistance to rotation, and an elevated foot support plate 224 mounted on the base 212 at a position forward and to the side of the rotatable foot support 216. The elevated foot support plate 224 provides a foot support surface elevated above the rotatable foot support plate 216.

The device 200 further includes a back support 222 that is selectively positioned horizontally, toward and away from the base 212, and handrails 220 connected to the base 212. Accordingly, device 200 provides internal and external resistance to isolate and exercise the gluteus medius and gluteus minimus muscle complex or the piriformis and synergists while the user is in a standing position, and also provides internal and external resistance to exercise the tibialis posterior and the peroneals in either the standing or seated position.

In the '747 patent, only one muscle area complex is actually addressed, that which is key in providing gains to the hips and lower back. Additionally, the back support 222 described in the '747 patent is an essential part of the exercise program. Further, device 200 employs a generally cumbersome means 236 of providing a smooth resistance and release of resistance. Specifically, rotational resistance is supplied in both directions of rotation via a system of tension springs, coil springs, hydraulic or pneumatic cylinders, a system of cams and springs, or a system of disks and brakes to provide rotating resistance to the rotatable foot plate 216. Moreover, front foot support plate 224 serves as an integral part of the exercise protocol.

Consequently, in light of some of the limitations described above, there is a significant need for a rotational resistance device which does not require a back support and/or a front foot support plate as an integral part of the exercise protocol, and which does not require the above-noted cumbersome means of providing smooth resistance and release of resistance. Further, there is a need for a device that provides the user an ability to exercise most if not all the muscles in the body, including but not limited to muscles in an around the lower back, hips, core, knees, ankles, shoulders, elbows, and wrist.

SUMMARY

An example embodiment is directed to a rotational resistance system adapted for a user so as to facilitate exercise of muscles throughout upper and lower extremities of the user's body. The system may include a pair of separate rotational resistance devices in side-by-side relation for placement of a corresponding hand or foot of a user thereon. Each device may further include a base adapted for placement on a floor or planar surface, a hollow foot support structure on the base, a top surface of which is inclined at an upward angle relative to horizontal as taken from the rear of the foot support structure to the front of the foot support structure, and a rotatable foot plate contained in and serving as part of the top surface of the foot support structure, the foot plate connected to a means for providing resistance and release of resistance.

Another example embodiment is directed to a system including a pair of separate rotational resistance devices in side-by-side relation for placement of a corresponding hand or foot of a user thereon, whereby each device may further include a foot support structure supported on a planar surface, a top surface of which is inclined at an upward angle relative to horizontal as taken from the rear of the foot support structure to the front of the foot support structure, and a rotatable foot plate serving as part of the top surface and adapted to resist rotation of a user's foot or hand thereon during exercise protocols to exercise muscles throughout upper and tower extremities of the user's body.

Another example embodiment is directed to a system adapted to provide rotational resistance to a user during exercise, the user having under active and overactive muscles, the system having a pair of separate rotational resistance devices in side-by-side relation for placement of a corresponding hand or foot of a user thereon, whereby each device may further include a base, and at least one rotatable foot plate supported on the base and adapted to resist rotation of the user's foot or hand thereon during exercise protocols for exercising muscles throughout upper and lower extremities of the user's body, exercise thereon by the user activating the under active muscles while releasing the overactive muscles so as to achieve myofascial balance between the under active and overactive muscles.

BRIEF DESCRIPTION OF THE DRAWINGS

Example embodiments will become more fully understood from the detailed description given herein below and the accompanying drawings, wherein like elements are represented by like reference numerals, which are given by way of illustration only and thus are not limitative of the example embodiments herein.

DETAILED DESCRIPTION

Figure 2:
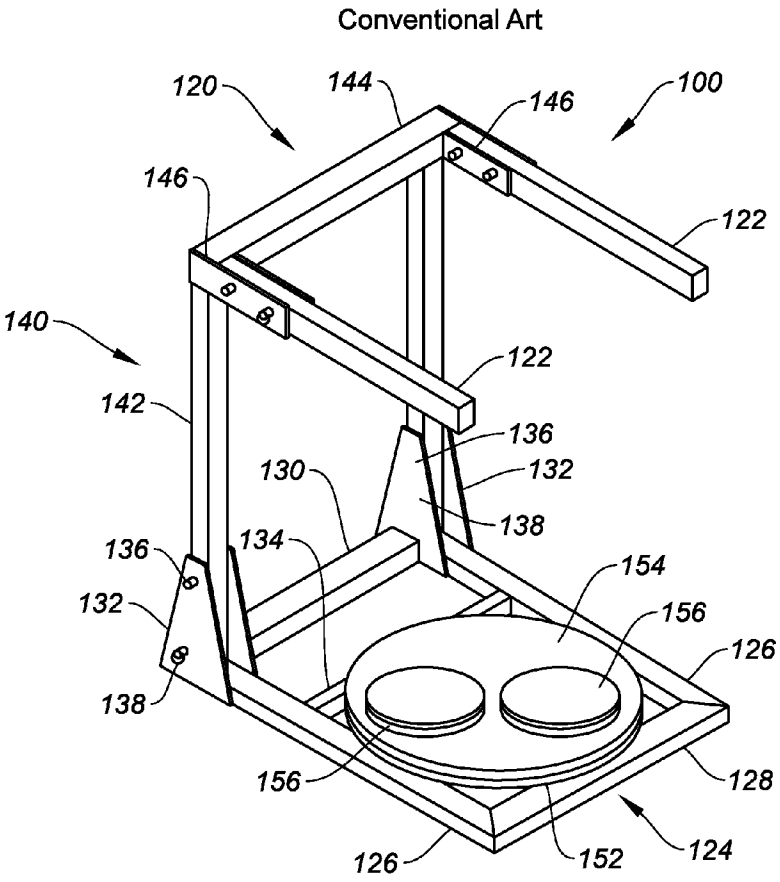
FIG. 2 is a partial isometric view of another conventional rotational exercise apparatus.
Figure 1:
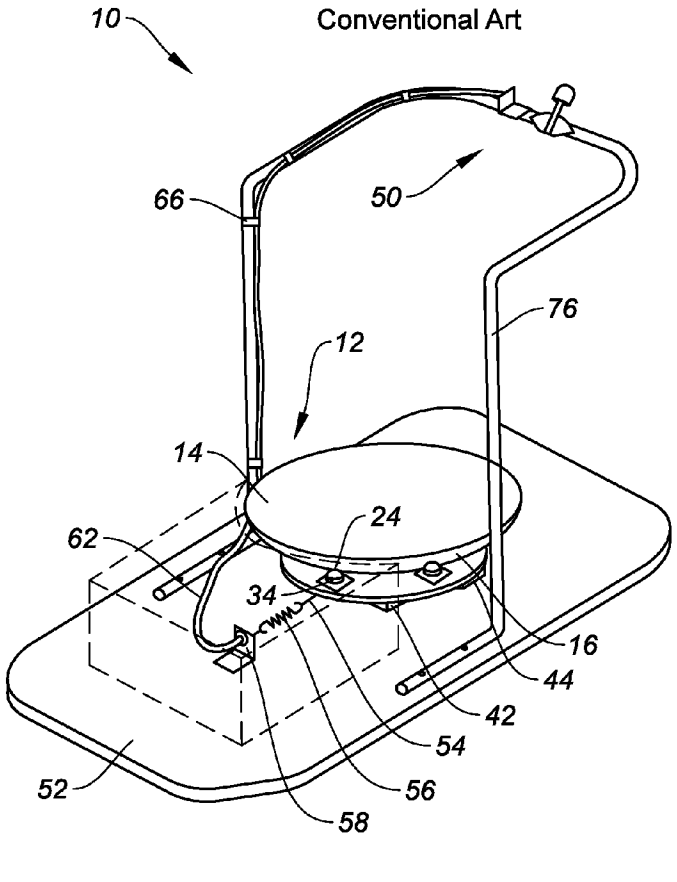
FIG. 1 is a perspective view of a conventional exercise and therapy device.
Figure 4:
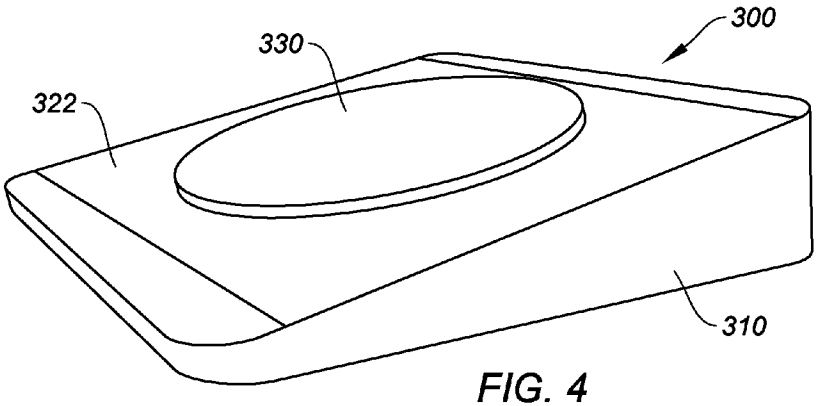
FIG. 4 is a perspective view of a rotational resistance device according to an example embodiment.
Figure 5:
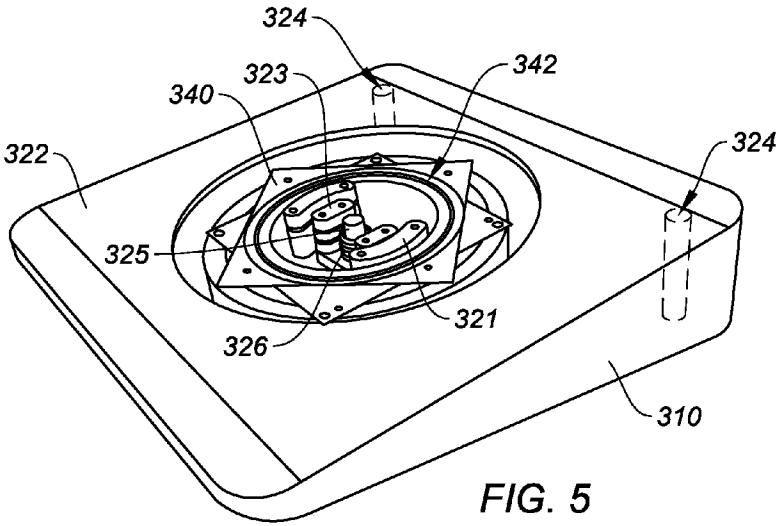
FIG. 5 is a perspective view of the device of FIG. 4 with selected structure removed to illustrate the turntable in more detail.
Figure 3:
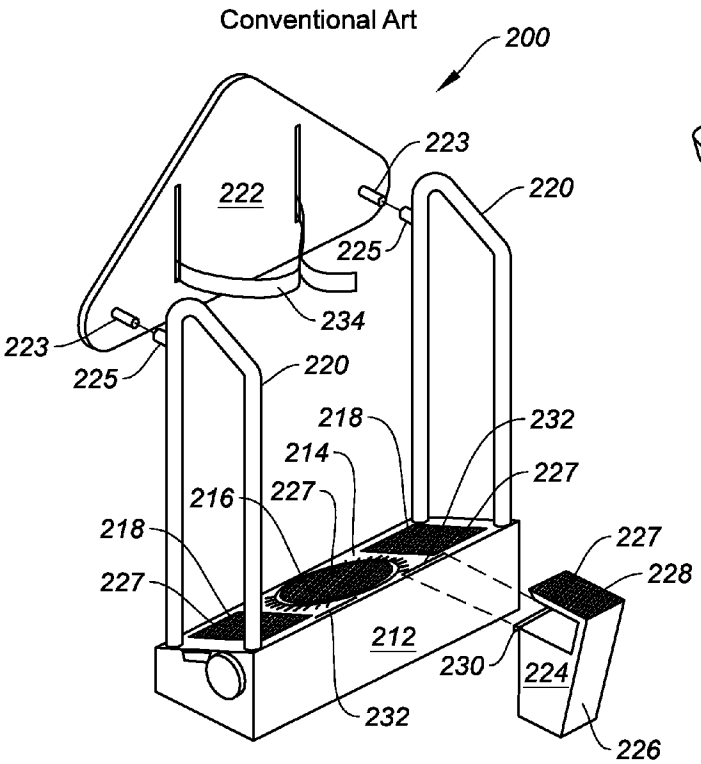
FIG. 3 is a front perspective exploded view of another conventional exercise device which imparts resistance to rotational movement.
Figure 6:
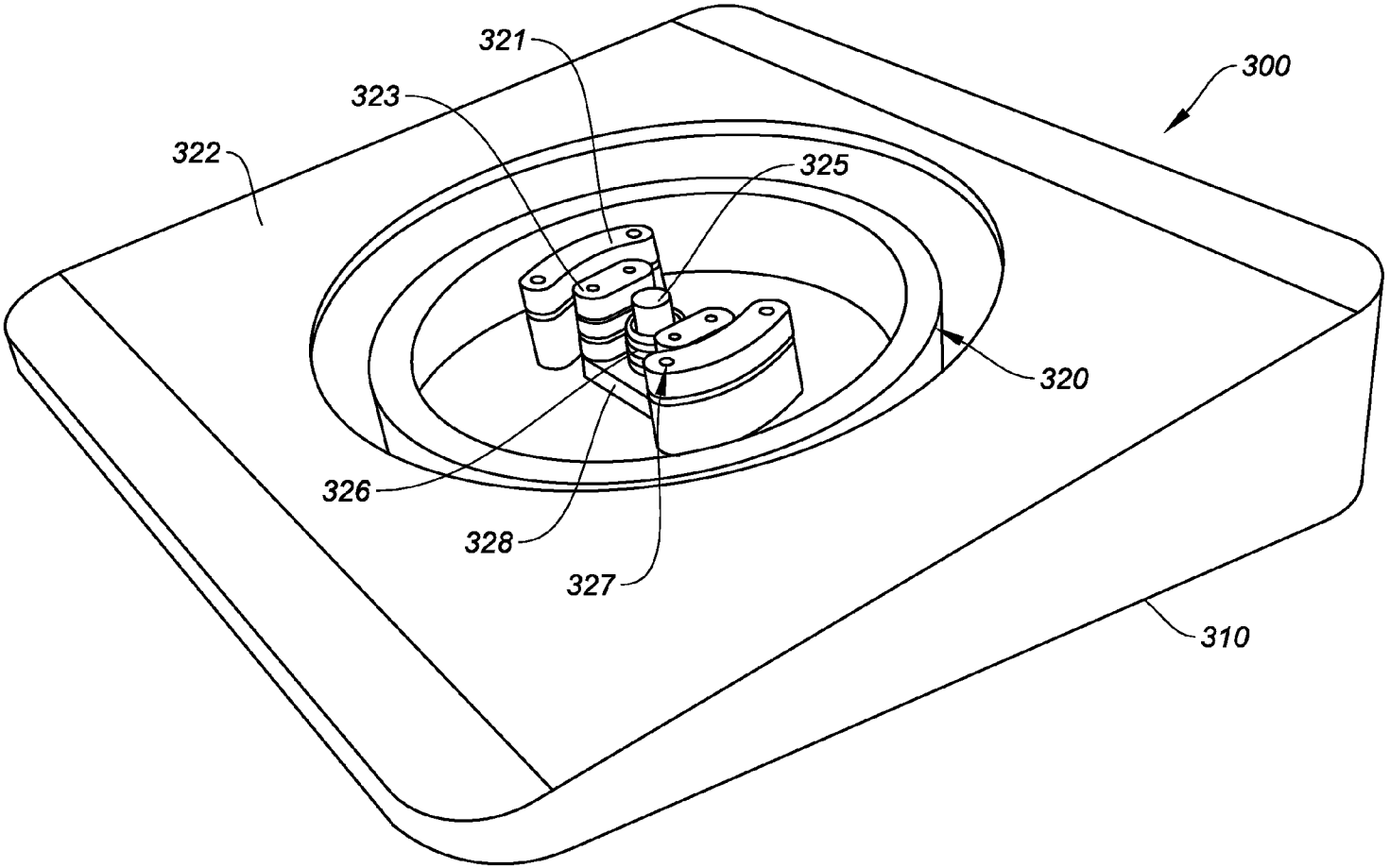
FIG. 6 is a perspective view of the device of FIG. 4 with selected structure removed to illustrate mounting structure and the spring in more detail.

In the following description, certain specific details are set forth in order to provide a thorough understanding of various example embodiments of the disclosure. However, one skilled in the art will understand that the disclosure may be practiced without these specific details. In other instances, well-known structures associated with manufacturing techniques have not been described in detail to avoid unnecessarily obscuring the descriptions of the example embodiments of the present disclosure.

Unless the context requires otherwise, throughout the specification and claims that follow, the word "comprise" and variations thereof, such as "comprises" and "comprising," are to be construed in an open, inclusive sense, that is, as "including, but not limited to."

Reference throughout this specification to "one example embodiment" or "an embodiment" means that a particular feature, structure or characteristic described in connection with the embodiment is included in at least one embodiment. Thus, the appearances of the phrases "in one example embodiment" or "in an embodiment" in various places throughout this specification are not necessarily all referring to the same embodiment. Further, the particular features, structures or characteristics may be combined in any suitable manner in one or more example embodiments.

As used in this specification and the appended claims, the singular forms "a," "an," and "the" include plural referents unless the content clearly dictates otherwise. The term "or" is generally employed in its sense including "and/or" unless the content clearly dictates otherwise.

As used in the specification and appended claims, the terms "correspond," "corresponds," and "corresponding" are intended to describe a ratio of or a similarity between referenced objects. The use of "correspond" or one of its forms should not be construed to mean the exact shape or size. In the drawings, identical reference numbers identify similar elements or acts. The size and relative positions of elements in the drawings are not necessarily drawn to scale.

In general, an example rotational resistance device as to be described in more detail hereafter is adapted for use against a flat surface such as a wall. Not only does the wall assist with balance and support for the user, but it also serves as a brace so that the user may selectively add sufficient resistance to the rotation of the device while maintaining their trunk and core stable (which cannot be accomplished otherwise). Example target areas which may be exploited by a user of the example rotational resistance device for exercise may include but are not limited to the muscles in and around the lower back, hips, core, spine, knees, ankles, shoulders, elbows, and wrists. The example rotational resistance device is specifically adapted to the user based on physiology and biomechanics principles in order to facilitate injury prevention and rehabilitation after injury.

The example rotational resistance device (hereafter "device 300"), in reference to FIGS. 4-7, is designed to be employed with the user standing on two devices 300 in spaced, adjacent relation on a floor or planar surface, while leaning against a flat wall and/or with the hands and knees of the user stabilized on a floor. Use of the example device 300 while leaning on a flat wall or stabilized on a floor offers relaxation to the muscles that tend to be overused, and simultaneously provides strong activation to underused muscles. By using the device 300 as instructed, a muscle and fascial release is acquired; this may be elicited in about 1.5 minutes.

Referring to FIG. 4-7, each device 300 may include a base 310 having a hollow cylindrical central portion which houses a foot support structure 320 therein. A top surface 322 of the base 310 and upper portion of the foot support structure 320 are each at an angle of inclination relative to horizontal. A circular rotatable foot plate 330 adapted to receive a foot or hand of the user is provided on top surface 322 of base 310, as shown.

Optionally, device 300 may be provided with a vibration attachment, not shown, to vibrate the rotatable foot plate 330 during exercise. In an example, the vibration attachment may be an electromagnetic vibration device attached to the foot plate 330, and configured at a given or variable vibration frequency. Vibration helps activate the muscles which are contracting to provide more action potentials during the time the muscles are being exercised.

Device 300 employs a "Lazy Susan" turntable 340 connected to an underside of foot plate 330, and a door knob-type spring 326 within the foot support structure 320 for smoother movement and symmetrical tension from side to side. Thus, device 300 and current exercise protocols do not require and do not advocate the use of a front foot support as shown and described in the '747 patent. The spring 326 is actuated to impart tension (and hence resistance to rotation of foot plate 330) via a spring actuator 321. The turntable 340 is secured to the spring actuator 321 via a suitable fastening means (not shown) such as screws, rivets, etc. engaging tapped bores 327 in the spring actuator 321. As the turntable 340 rotates, it will turn the spring actuator 321 so as to engage spring 326, generating tension.

A pair of post supports 323 extends up from a post support base 328. The post supports 323 are continuous with post 325 to keep the post 325 from torquing in any other direction besides pure rotation. This prevents the post 325 from eventually breaking off due to over-torque.

The example device 300 may be manufactured with a preset 11° angle of inclination from horizontal for the top surface 322 of base 310 and that of the foot support structure 320. This puts certain muscles at a mechanical disadvantage, allowing their functionally opposite muscles to attain greater activation and an increased range of motion. Variable elevations for the top surface of base 310 and that of the foot support structure 320 from 6° to 26° are available to provide different levels of exercise; lower elevations provide a less difficult exercise and higher elevations are more strenuous.

Through extensive testing, the inventor has discovered that elevation changes to the device 300 dramatically affect the difficulty level in order for a user to rotate the turntable 340. As the top surface 322 and foot plate 330 can be variably adjusted to elevations from 6° to 26°, testing has shown that angles of inclination greater than or equal to 20° is exponentially more difficult than an inclination set of 11°. Employing a simple wedge which is the exact same size as that of the base 310 would enable further addition or subtraction to this range of elevation. This is a much simpler and superior means in which to add or reduce tension.

Figure 7:
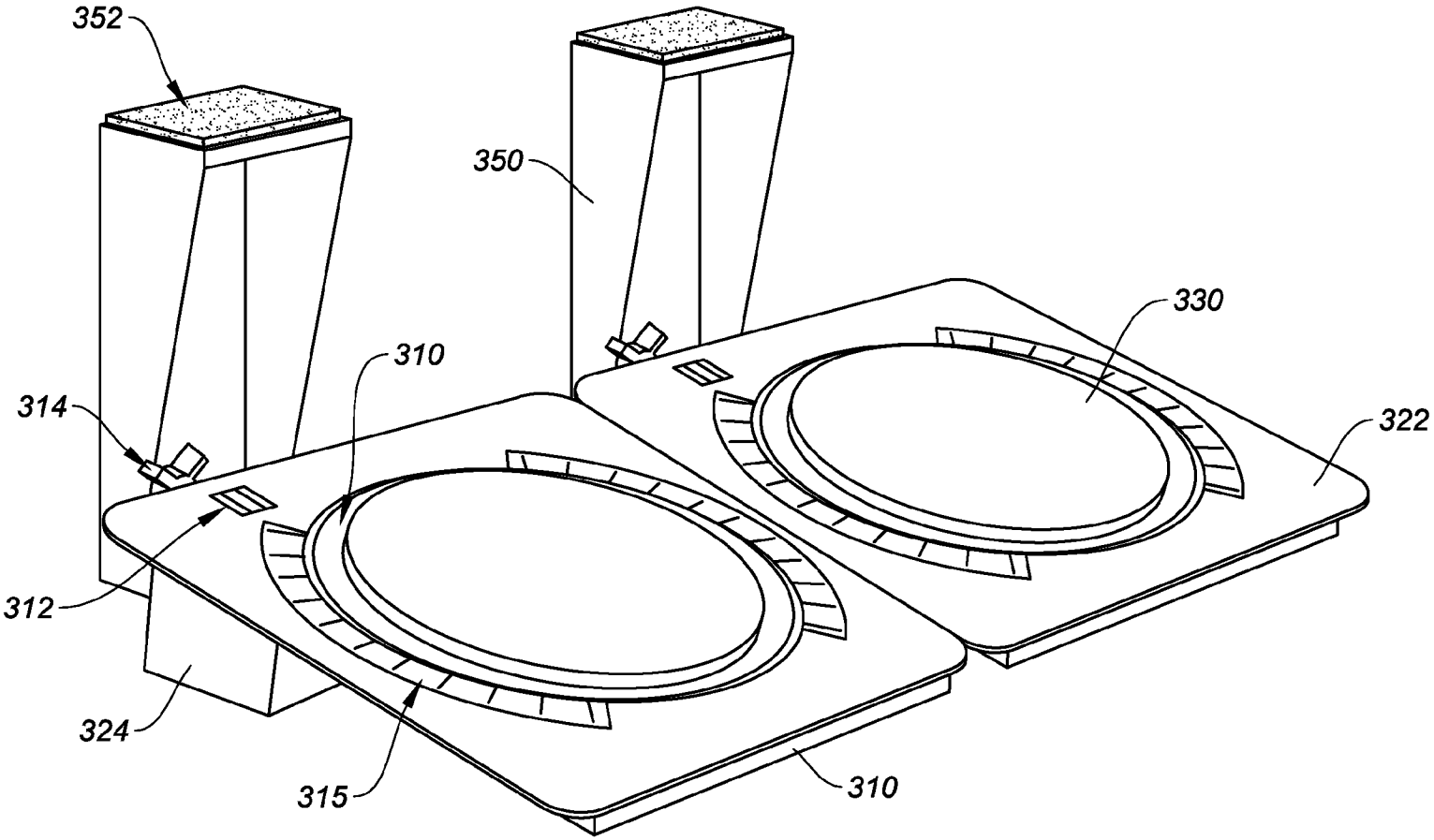
FIG. 7 illustrates a user implementing an example exercise protocol with the device of FIG. 4.

In FIG. 7, the top surface 322 may include a tension indicator sticker 312 having tension indicator window. The window may include visual increment indicia on a scale of 0-8 relative to the tension imparted by spring 326. Device 300 optionally may include a tension knob 314 adapted to tighten a compression spring. Additionally, a degree of rotation indicator 315 may be provided on top surface 322. Indicator 315 may include visual indicia illustrating a range of rotation between 0-50 degrees in either direction, both internal and external ranges. Device 300 may further optionally include a pair of front foot stabilizer plates 350 as previously described in the '747 patent. However, use of stabilizer plates 350 are unnecessary when using two devices 300 in side by side relation for exercise (vice one device in the '747 patent).

In general, the housing of device 300, inclusive of base 310, foot support structure 320, rotatable foot plate 330, and turntable 340 may be formed by an injection molding process from a medium or heavy gauge impact plastic such as acrylonitrile butadiene styrene (ABS). ABS is an easily machined, tough, low-cost, rigid thermoplastic material with medium to high impact strength, and is a desirable material for turning, drilling, sawing, die-cutting, shearing, etc.

ABS is merely one example material; equivalent materials include various thermoplastic and thermoset materials that have characteristics similar to ABS. For example, polypropylene, high-strength polycarbonates such as GE Lexan, and/or blended plastics may be used instead of, or in addition with ABS. The materials comprising device 300 (plastic such as ABS, rubber and lightweight metal materials) provide a light yet durable device 300. An exemplary injection molding system for forming molded plastic articles included in device 300 may be the Roboshot® injection machine from Milacron-Fanuc. The Roboshot is one of many known injection molding machines for forming plastic injection molds.

Proper use of the device 300 enhances alignment, explosion and durability for the user. For example, device 300 may be particularly applicable to users who cannot body squat to a parallel position, by enabling them to achieve a full squat after just a few days of use of the device 300 with the suggested exercise protocols. This is significant, as the inability to perform a deep squat is generally a top injury predictor in many college and professional sports.

Device 300 also is adapted to help a user dramatically increase their hip, ankle and shoulder ranges of motion. Specific muscles activated by the example device 300 for an internal hip rotation exercise may include but are not limited to the gluteus medius, tensor fascia lata, adductor magnus, semimembranosis, rectus abdominis, gluteus maximus, hamstrings, internal abdominal oblique, transverse abdominis, tibialis anterior, and tibialis posterior muscles. Specific muscles released by the example device 300 for internal hip rotation may include but are not limited to the piriformis, gemellus superior, gemellus interior, obturator internus, obturator externus, quadratus femoris, external abdominal oblique, lower paraspinal muscles, and peroneus longus muscles.

Specific muscles activated by the example device 300 for a squat exercise may include but are not limited to the tibialis anterior, tibialis posterior, and peroneus longus muscles. Specific muscles and tendons released by the example device 300 for a squat exercise may include, but are not limited to the gastrocnemius and soleus muscles, and the Achilles tendon. Specific muscles activated by the example device 300 for an external shoulder rotation exercise may include but are not limited to the rhomboids, infraspinatus, teres minor, posterior deltoid, serratus anterior, lower trapezius, serratus posterior inferior, and pectoralis minor muscles. Specific muscles released for external shoulder rotation may include but are not limited to the latissimus dorsi, subscapularis, teres major, upper trapezius, serratus posterior superior, and pectoralis major muscles.

Device 300 and its associated exercise protocols are specifically tailored to addressing factors related to pain and stiffness, including but not limited to muscle and fascial balance, flexibility and range of motion, back and hip pain, and shoulder and neck pain. There are all kinds of reasons for pain and stiffness, but muscle imbalance outranks all others combined. Every muscle and group of muscles in the body has an opposite muscle, or set of muscles. When one set of muscles, like the lower back muscles, are short and too tight, the opposite set will be long and weak, like the abdominals. This is referred to as muscle imbalance. The same is true of the fasciae which covers all the muscles throughout the body.

One large problem muscle imbalance causes is that it creates a constant strain on the group of muscles that are long and weak, which causes both discomfort and inflexibility—when a muscle is too long, and it is stretched further, the body will tighten even more to keep it from tearing. If dramatic enough, short muscles on one side of a joint, such as the hip or the shoulder, will cause the joint to be very tight, will limit movement in that joint and, given enough time in that poor position, will cause the joint to deteriorate, needlessly.

Device 300 and its associated exercise protocols help to restore muscle and fascial balance. Every exercise recommended to be performed on device 300 relaxes short muscles, while creating a strong contraction of the long and weak muscles, helping to correct imbalances of length and strength in muscles. Just one use on device 300 will begin to create more muscle and fascial balance. Using device 300 diligently will help to permanently balance muscles and fasciae and will help restore flexibility and mobility.

Good flexibility is simply being able to move through a complete range of motion in all directions. Lack of flexibility can be due to many things, but the top reason is muscle imbalance. A common misunderstanding about flexibility and range of motion is that they have only to do with the length of muscles. Actually, flexibility and range of motion are much more dependent on the length and strength ratios from one set of muscles to the other.

Device 300 and its associated exercise protocols are built upon achieving the proper length and strength between muscles that tend to be short and overactive, in relation to their opposite muscles, which tend to be too long and underactive. When this is achieved, flexibility and range of motion improve immediately in about 85% of the population. Even in the other 15%, extra strength added to weak muscles will create more stability and balance in the body.

It is the inventor's position that strong glutes and balanced hips have more to do with a healthy back than any other factor. There are many different reasons for lower back and hip pain that cannot be addressed by device 300 and its protocols. However, device 300 does help correct muscle imbalance which, by far, is the number one cause of hip and lower back pain and stiffness.

In the majority of the population, lower back and hip pain and stiffness may be resolved by a diligent program of balancing the muscles around them. Especially in the active and athletic populations, most people are prone to have a forward tilted pelvis, which compresses the lower back and puts undue stress on the hips. Simply temporarily correcting that position brings immediate relief in most cases, and correcting it permanently usually completely resolves the problem.

Device 300 and its associated exercise protocols are designed to correct problems of lower back and hip position. There are three main components of the problem and device 300 addresses all three, and helps correct them all at the same time, and in a very short time. Each exercise, while using device 300, takes less than a minute. This is accomplished by strengthening every long and under active muscle in and around the hips and lower back, and by relaxing each short and overactive muscle, all at the same time. This creates a more stable and relaxed body position.

It is the inventor's position that strong, balanced shoulders have more to do with a healthy neck than any other factor. Most of the muscles that support the neck originate from the shoulders. Balancing the shoulder muscles in all three planes, from front to back, side to side, and in rotation, offers more permanent relief for the neck than any other factor, technique, exercise or modality. Most active people carry their shoulders in a poor position. Because of our lifestyle and work patterns, we tend to carry our shoulders upward, forward, and rotated inward. These positions not only put stress on the shoulder itself, they also put undue stress on the neck because the position of the neck is a mirror of the position of the shoulders.

The shoulder program implemented with device 300 works to correct these positions, relieving tension on the shoulder and the neck. This is accomplished by balancing the muscles of the shoulders—strengthening the groups of muscles that are long and under active, and relaxing the ones that are short and overactive.

The example device 300 may be employed in the following activities: warm-up/activation before and recovery after exercise, rehabilitation from injury, functional training, and performance. For warm-up, moving freely, without restriction, in any sport, exercise or activity is a joy. Movement through a complete range of motion in all planes of motion is essential to superior performance. Device 300 and its associated exercise protocols specifically strengthen many muscles which tend to be long and weak, and simultaneously relax those muscles that are too short, in the overwhelming amount of athletes. Research articles, such as one by Matthew F. Kritz, et al. entitled Static Posture Assessment Screen of Athletes: Benefits and Considerations—Strength and Conditioning Journal October 2008—Volume 30—Issue 5—pp. 18-27, state that about 85% of athletes have the same muscle imbalance issues. Device 300 has been designed to correct these specific muscle imbalances. This immediately increases flexibility and range of motion, allowing the body to move more freely and dynamically, and with a reduced chance of injury.

For recovery, the key to consistent, sustained performance is getting the body back into the same position as it was before the activity, every time, after strenuous exercise. If not, two things will suffer—the body and performance. While it is important to replenish the body with the proper nutrition and fluids for recovery after sport and exercise, it is actually as important to return it back to its best structural position—a neutral position. This allows the body to relax, by reducing inflammation caused by exercise and taking needless stress off muscles and joints.

If a recovery program takes too long, the chances are a person will not do it consistently. Using device 300 in accordance with its associated exercise protocols takes approximately one and a half (1.5) minutes to balance most major muscles used in sports and exercise, immediately bringing it to a more neutral position.

Rehabilitation is the job of a specialist, such as a physical therapist, athletic trainer, chiropractor, or neuromuscular therapist. It implies an injury that needs serious and professional attention. Device 300 is believed to be an excellent tool in a professional's clinic for a host of athletic type injuries. Used with the professional's own protocols, device 300 can be beneficial in rehabilitating and further preventing the following injuries: sports hernia, low ankle, high ankle, ACL, knee, patella-femoral tendonitis, hamstring, hip, lower back, shoulder, elbow, wrist, and spine.

Injury prevention is an in-exact science and is dependent on many factors. No matter how much effort is put into preventing injury, high force/high speed impact, as in football or a car accident, will cause damage to the body. Device 300 and its associated exercise protocols are designed to prevent needless injury to the body. Used within a solid training program, it has proved to be beneficial in preventing the following injuries: Sports Hernias, ankle, knee, hamstring, hip, lower back, shoulder, and elbow. Device 300 further is unique in that it takes so little time to use; thus people actually may use it daily. This helps to keep the body in a consistently neutral position—the optimal position to resist and prevent injury.

The example device 300 may be intended for use by an individual or family to insert into their existing fitness program, and may prove to be a valuable asset for active individuals, novice and elite athletes, healthcare professionals, athletic coaches and trainers, and mobile service personnel (such as military, fire, and police). The example device 300 may be particularly suitable for use by college athletic teams and athletes in their weight rooms and on travel by select teams within their systems.

As an example, football, basketball, soccer, and volleyball are sports that demand many different kinds of movement; hence these sports require strength in all the muscles of the body, not only the ones that produce force. When the same muscles are used over and over to produce the same movement pattern, such as sprinting, jumping, blocking, tackling, cutting, kicking, etc, those muscles will become stronger and shorter than other important muscles. This creates a muscle imbalance that leads to strain, stiffness, pain, and eventual injury.

Device 300 and its associated exercise protocols are specifically designed to relax these force producing muscles while simultaneously demanding a strong contraction from their opposite muscles—the ones that reduce force (in other words, to help stop the action rather than to create it). When used for warm-up and recovery, device 300 and its associated exercise protocols immediately returns the body back to a more neutral position, making it more "opened up" and "ready for action". This neutral position is also the best for consistent performance, reducing needless inflammation, and greatly cutting down on the incidence of several sport related injuries—sports hernia, ankle, calf/Achilles, knee, hamstrings, hip, oblique, groin, lower back, shoulder, and elbow.

As another example, predominantly rotational sports like golf, baseball, tennis, and any other swinging or throwing sports have special considerations. Unlike other sports where the rotational muscles are merely stabilizers, now the rotators become the ones that actually create the movement, so they must be strengthened and trained to do so.

Device 300 and its associated exercise protocols effectively strengthen the muscles that generate the power, create the speed, and as importantly, stop the rotational speed before it damages the joints, even in the most gifted athletes. Used for warm-up, device 300 brings the body to a more neutral position which promotes consistent performance, and provides more available range of motion (useable flexibility). When used directly after sport or exercise, the body returns to a position which reduces inflammation and promotes faster healing—this is called recovery. Also, a body free of stiffness and pain is much less likely to be injured, one of the biggest advantages of device 300 for reducing the incidence of lower back, ankle, calf/Achilles, knee, hamstring, groin, oblique, shoulder, elbow, and sports hernia/lower abdominal Injury.

As a further example, sports such as track, swimming, and cycling are basically straight ahead actions, except for flip turns in swimming (which most resemble the action of a gymnast or diver, as discussed in more detail below), and all have a basic "stroke"—either a stride in track, a stroke in swimming or a revolution in cycling. Since the body is going straight forward, the rotational muscles act primarily as stabilizers, but also to create a quick stop to the rotation of the hips and trunk to keep the body from wasting energy by allowing it to turn needlessly.

Device 300 does provide the muscles which stabilize movement with ample strength to keep the body moving directly forward. However, the exercises performed on device 300 also create more range of motion for the ankles, hips, spine and shoulders, which help athletes to generate a more fluid stride, stroke or revolution.

Sports like gymnastics, diving, high jump, pole vault, discus, shot put, hammer throw, etc, require combined power of jumping and thrusting, and speed of full body rotation. Device 300 and its associated exercise protocols address all those requirements for these athletes. While there are other individual exercises that may help to develop more power, thrust and speed, device 300 targets them all at once in a few exercises that take literally one minute each for warm-up and recovery, and which help prevent injury to the most often injured areas of the body in these sports. Inherent to the fundamental exercise on device 300, it dramatically reduces oblique, groin, hamstrings, ankle, lower back and shoulder injuries, as well as sports hernia.

Figure 8:
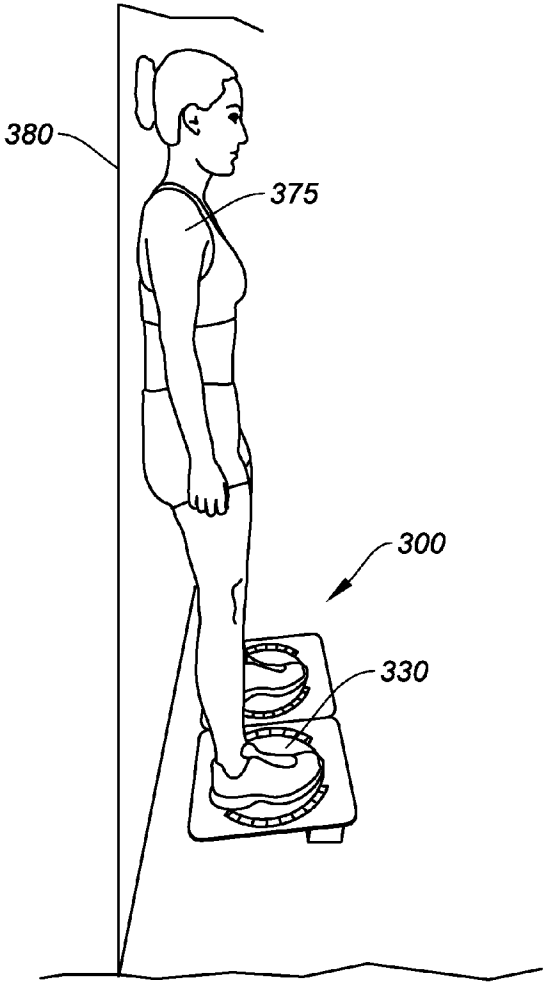
FIG. 8 is a perspective view of a pelvic tilt exercise protocol with the example rotational resistance device in accordance with the example embodiment.

FIG. 8 is a perspective view of a pelvic tilt exercise protocol with the example rotational resistance device in accordance with the example embodiment. To prepare for this protocol, a user 375 places their feet a foot-width distance from a vertical surface such as wall 380. Their back contacts the wall 380, and to mount device 300, the user 375 places one foot on the device 300 between the two turntables 340, then moves the feet laterally so each foot is centered on a foot plate 330 of a respective turntable 340.

As one example exercise protocol for the pelvic tilt, the user 375 will move their tailbone down and forward while maintaining their back flat on wall 380. With their feet, they will rotate each plate 330 inward a first angle against resistance (such as is shown in FIG. 8), hold for 10 seconds, then return feet forward. Next, they will attempt to lower their tailbone even further down (only using the muscles above the knees), repeat the inward rotation to a second angle from forward that is greater than the first, hold for 10 seconds, then return their feet forward on the plates 330. The previous movements are repeated a third time, with tailbone lowered even further and inward rotation to a third angle from forward greater than the second, hold for 10 seconds, then rest. The user 375 then dismounts from device 300 and walks around in a rest period. Optionally, vibration of the foot plates 330 during the above exercise protocol may be added so as to activate the muscles which are contracting, thereby providing more action potentials during the time the muscles are being exercised.

Figure 9:
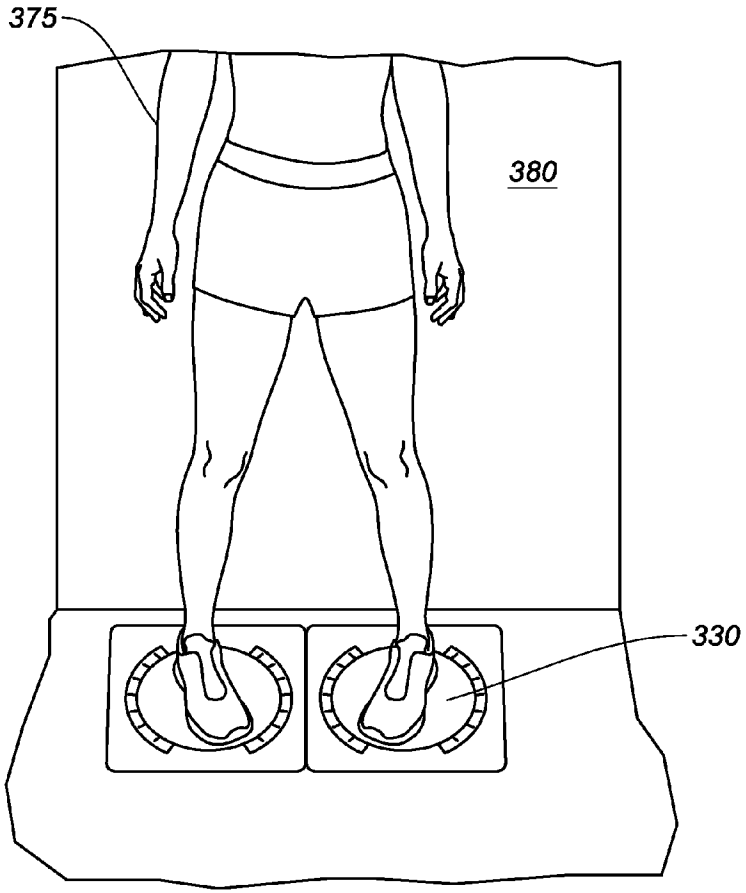
FIG. 9 is a perspective view of an inward hip rotation exercise protocol with the example rotational resistance device in accordance with the example embodiment.

FIG. 9 is a perspective view of an inward hip rotation exercise protocol with the example rotational resistance device in accordance with the example embodiment. Similar to the above, the user 375 stabilizes themselves on the wall 380 with feet centered on the foot plates 330 of turntables 340. This creates a posterior pelvic tilt, placing the maximum muscles in and around the hips, pelvis and spine in a position so as to be activated or released. Holding the posterior pelvic tilt throughout, the user 375 turns inward with the hips which, in turn, forces the feet inward, rotating the foot plates 330 on turntables 340. The hips are turned inward to maximum amount, three consecutive times, each time holding maximum rotation for 10 seconds. Optionally, vibration of the foot plates 330 during the above exercise protocol may be added so as to activate the muscles which are contracting, thereby providing more action potentials during the time the muscles are being exercised.

Figure 10:
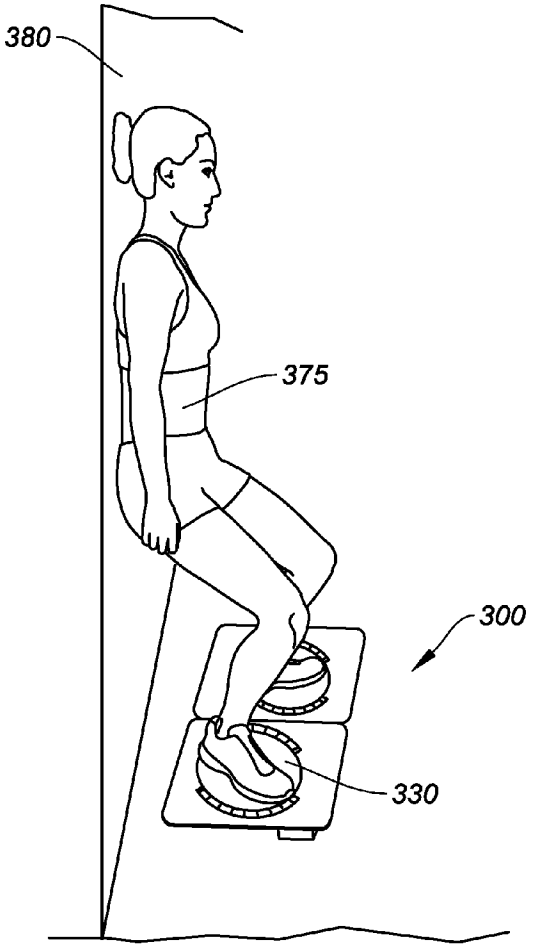
FIG. 10 is a perspective view of a squat exercise protocol with the example rotational resistance device in accordance with the example embodiment.

FIG. 10 is a perspective view of a squat exercise protocol with the example rotational resistance device in accordance with the example embodiment. To prepare for this protocol, the user 375 orients themselves exactly as they did for the pelvic tilt protocol: feet a foot-width distance from wall 380, back against the wall 380, and centering each foot on a foot plate 330 of a respective turntable 340.

As one example exercise protocol for the squat, the user 375 pushes each heel down onto the back of a corresponding foot plate 330 as hard as they can do so; toes up. They will then slowly inch down the wall 380 (a squat) until they feel a stretch in the back of their calves and Achilles, then stop. With their knees pointing straight forward, the user 375 then rotates the toes of each foot inward toward each other, pushes the heels down even harder, and holds the squat position for 10 seconds (such as is shown in FIG. 10), thereafter returning feet forward on foot plates 330 and maintaining the squat position. The user 375 then squats further down the wall 330, and thereafter pushes their heels downward forcefully. This is repeated, but the user 375 squats even a bit deeper down the wall 380, stops, presses heels hard down, and rotates feet inward (or outward) and holds for 10 seconds. Thereafter, the user 375 returns their feet forward on foot plates 330 and rises back up on wall 380.

This is repeated a third time, down at a deeper squat and opposite foot rotation, held for 10 seconds. During the entire 30 second exercise, the user 375 never returns to the starting position, so as to maintain the squat gain they have achieved. The user then returns feet forward, lifts up, dismounts the device 300, and walks around in a rest period. Optionally, vibration of the foot plates 330 during the above exercise protocol may be added so as to activate the muscles which are contracting, thereby providing more action potentials during the time the muscles are being exercised.

Figure 11:
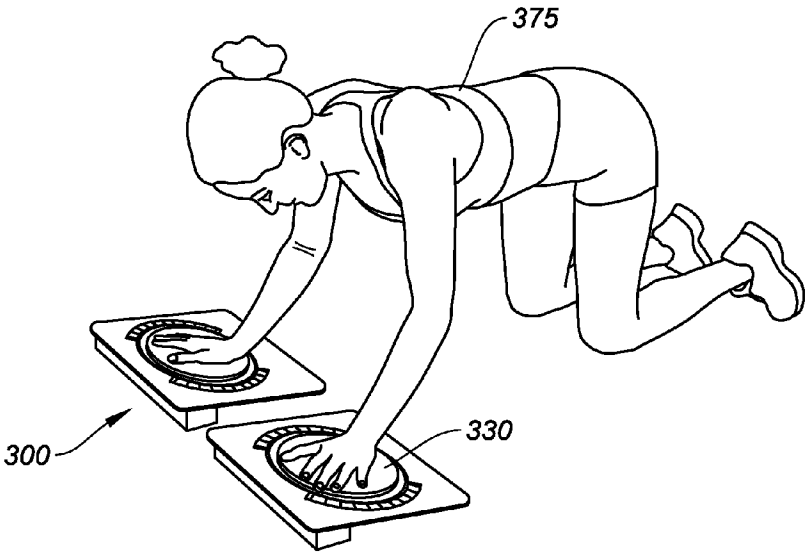
FIG. 11 is a perspective view of a shoulder rotation exercise protocol with the example rotational resistance device in accordance with the example embodiment.

FIG. 11 is a perspective view of a shoulder rotation exercise protocol with the example rotational resistance device in accordance with the example embodiment. To prepare for this protocol, the user 375 positions their hands slightly wider than shoulder-width apart, places each hand on the center of a corresponding foot plate 330, places knees on the ground so they are directly under the hips of the user 375. For this example exercise protocol, the user 375 locks out their elbows, and slowly bring their chest to the floor, so that it appears as if their spine is curved in a concave plane, as shown in FIG. 11. In this position, they will rotate each shoulder in to an outward position on a corresponding foot plate 330 approximately 30° outward from forward, and hold for 10 seconds. This exercise is repeated twice more at 10 second intervals, but with shoulders rotating outward on foot plates 330 approximately 40° for repetition 2, and 50° for repetition three. Similar to the squat protocol, the user 375 never returns their hands/shoulders back to the neutral or starting position until the entire 30 exercise has been completed. The user then dismounts the device 300 and walks around in a rest period. Optionally, vibration of the foot plates 330 during the above exercise protocol may be added so as to activate the muscles which are contracting, thereby providing more action potentials during the time the muscles are being exercised.

Accordingly, the example device 300 may provide several benefits. For example, the foot support structure 320 is adapted to bring major joints to a neutral position; use of the device 300 acts to relieve most mechanical-type hip and back pain, and increases power of the core. Additionally, use of the device 300 relaxes overactive muscles, increases hip motion, and improves action of the hips and pelvis. Further, use of the device 300 may increase stability of the ankles, knees, hips, spine, and shoulders, provides pre-exercise activation of all rotational muscles in the entire body, and offers recovery from exercise. Moreover, use of the device 300 may increase strength and stability of the shoulder and of all the small muscles around the spine.

The example embodiments having been described, it is apparent that such have many varied applications. For example, the example embodiments may be applicable but not limited to connection to various devices, structures and articles.

The present invention, in its various embodiments, configurations, and aspects, includes components, systems and/or apparatuses substantially as depicted and described herein, including various embodiments, sub-combinations, and subsets thereof. Those of skill in the art will understand how to make and use the present invention after understanding the present disclosure. The present invention, in its various embodiments, configurations, and aspects, includes providing devices in the absence of items not depicted and/or described herein or in various embodiments, configurations, or aspects hereof, including in the absence of such items as may have been used in previous devices, e.g., for improving performance, achieving ease and\or reducing cost of implementation.

The foregoing discussion of the invention has been presented for purposes of illustration and description. The foregoing is not intended to limit the invention to the form or forms disclosed herein. In the foregoing Detailed Description for example, various features of the invention are grouped together in one or more embodiments, configurations, or aspects for the purpose of streamlining the disclosure. The features of the embodiments, configurations, or aspects of the invention may be combined in alternate embodiments, configurations, or aspects other than those discussed above. This method of disclosure is not to be interpreted as reflecting an intention that the claimed invention requires more features than are expressly recited in each claim. Rather, as the following claims reflect, inventive aspects lie in less than all features of a single foregoing disclosed embodiment, configuration, or aspect. Thus, the following claims are hereby incorporated into this Detailed Description, with each claim standing on its own as a separate preferred embodiment of the invention.

Moreover, though the description of the invention has included description of one or more embodiments, configurations, or aspects and certain variations and modifications, other variations, combinations, and modifications are within the scope of the invention, e.g., as may be within the skill and knowledge of those in the art, after understanding the present disclosure. It is intended to obtain rights which include alternative embodiments, configurations, or aspects to the extent permitted, including alternate, interchangeable and/or equivalent structures to those claimed, whether or not such alternate, interchangeable and/or equivalent structures disclosed herein, and without intending to publicly dedicate any patentable subject matter.

I claim:

1. A rotational resistance system adapted for a user so as to facilitate exercise of muscles throughout upper and lower extremities of the user's body, comprising:

a pair of separate rotational resistance devices in side-by-side relation for placement of a corresponding hand or foot of a user thereon, each device including:

a base adapted for placement on a floor or planar surface, a hollow foot support structure on the base, a top surface of which is inclined at an upward angle relative to horizontal as taken from the rear of the foot support structure to the front of the foot support structure, and a rotatable foot plate contained in and serving as part of the top surface of the foot support structure, the foot plate connected to a means for providing resistance and release of resistance.

2. The system of claim 1, wherein the means for providing resistance and release of resistance is adapted to be selectively varied by a user.

3. The system of claim 1, wherein device does not include a back support attached to the base or an elevated foot support plate attached to the base at a position forward of the rotatable foot plate.

4. The device system of claim 1, further comprising means for vibrating the foot plate.

5. The system of claim 1, wherein the angle of inclination is between 6 and 26 degrees from horizontal.

6. The system of claim 1, wherein the angle of inclination is 11 degrees from horizontal.

7. The system of claim 1, wherein device does not include handrails mounted to the base.

8. A system, comprising:

a pair of separate rotational resistance devices in side-by-side relation for placement of a corresponding hand or foot of a user thereon, each device including:

a foot support structure supported on a planar surface, a top surface of which is inclined at an upward angle relative to horizontal as taken from the rear of the foot support structure to the front of the foot support structure, and a rotatable foot plate serving as part of the top surface and adapted to resist rotation of a user's toot or hand thereon during exercise protocols to exercise muscles throughout upper and lower extremities of the user's body, and means for providing resistance to rotation of the foot plate and release of resistance.

9. The system of claim 8, wherein the angle of inclination is at leas 6 degrees from horizontal.

10. The system of claim 8, wherein device does not include handrails attached thereto.

11. The system of claim 8, wherein device does not include a back support attached thereto.

12. The system of claim 8, wherein resistance to rotation and release of resistance is adapted to be selectively varied by a user.

13. The system of claim 8, wherein the means for providing resistance to rotation and release of resistance further includes:

a turntable connected to each foot plate, a spring actuator attached to each turntable, and a spring adapted to impart resistance to rotation of a corresponding foot plate, rotation of the turntable actuating the spring actuator so as to engage the spring and generate tension.

14. The system of claim 13, further comprising a tension indicator with indicator window that includes visual increment indicia indicating a number relative to the tension imparted by the spring.

15. The system of claim 8, further comprising means for vibrating the foot plate.

16. A system adapted to provide rotational resistance to a user during exercise, the user having under active and overactive muscles, the system comprising:

a pair of separate rotational resistance devices in side-by-side relation for placement of a corresponding hand or foot of a user thereon, each device including:

a base, and at least one rotatable foot plate supported on the base having a top surface which is inclined at an upward angle relative to horizontal as taken from a rear of the foot support plate to a front of the foot support plate and adapted to resist rotation of user's foot or hand thereon during exercise protocols for exercising muscles throughout upper and lower extremities of the user's body, exercise thereon by the user activating the under active muscles while releasing the overactive muscles so as to achieve myofascial balance between the under active and overactive muscles, and means for providing resistance to rotation of the foot plate and release of resistance.

17. The system of claim 16, wherein the means for providing resistance to rotation and release of resistance further includes:

a turntable connected to each foot plate, a spring actuator attached to each turntable, and a spring adapted to impart resistance to rotation of a corresponding foot plate, rotation of the turntable actuating the spring actuator so as to engage the spring and generate tension.

18. The system of claim 16, wherein resistance to rotation and release of resistance is adapted to be selectively varied by user.

* * * * *